US009088109B2

(12) United States Patent
Little et al.

(10) Patent No.: US 9,088,109 B2
(45) Date of Patent: Jul. 21, 2015

(54) QUICK DISCONNECT CONNECTOR WITH INTEGRAL SUPPRESSION DIODE

(71) Applicant: Curtiss-Wright Flow Control Service Corporation, Falls Church, VA (US)

(72) Inventors: David Lynn Little, Madison, AL (US); Gary Joseph Elam, Huntsville, AL (US)

(73) Assignee: CURTISS-WRIGHT FLOW CONTROL SERVICE CORPORATION, Falls Church, VA (US)

( * ) Notice: Subject to any disclaimer, the term of this patent is extended or adjusted under 35 U.S.C. 154(b) by 241 days.

(21) Appl. No.: 13/872,543

(22) Filed: Apr. 29, 2013

(65) Prior Publication Data

US 2014/0322977 A1 Oct. 30, 2014

(51) Int. Cl.
*H01R 13/66* (2006.01)
*H01R 13/623* (2006.01)

(52) U.S. Cl.
CPC ..... *H01R 13/6641* (2013.01); *H01R 13/623* (2013.01)

(58) Field of Classification Search
USPC ..... 439/620.21
See application file for complete search history.

(56) References Cited

U.S. PATENT DOCUMENTS

| | | | | |
|---|---|---|---|---|
| 5,125,601 | A * | 6/1992 | Monford, Jr. | 244/173.1 |
| 7,104,844 | B2 * | 9/2006 | Akino | 439/620.21 |
| 7,329,054 | B1 * | 2/2008 | Epitaux et al. | 385/89 |
| 7,637,788 | B2 * | 12/2009 | Brusoe et al. | 439/722 |
| 7,963,773 | B2 * | 6/2011 | Palli et al. | 439/38 |
| 8,155,012 | B2 * | 4/2012 | Austermann et al. | 370/241 |
| 8,702,316 | B2 * | 4/2014 | DiFonzo et al. | 385/57 |

FOREIGN PATENT DOCUMENTS

EP 002256818 A1 * 12/2010 ..... H01L 31/02021

* cited by examiner

*Primary Examiner* — Jean F Duverne
(74) *Attorney, Agent, or Firm* — Pearne & Gordon LLP

(57) ABSTRACT

An electrical connector assembly for suppressing a back electromotive force ("EMF") spike originating from an electromagnetic device is provided. The electrical connector assembly includes a pin-side electrical connector coupled to the electromagnetic device. In one example, the pin-side electrical connector has a diode opening surrounded by an insulating material. The electrical connector assembly further includes a socket-side electrical connector for mechanically mating with and electrically coupling to the pin-side electrical connector. The socket-side electrical connector includes a suppression diode for suppressing the back EMF spike from the electromagnetic device. The suppression diode is positioned within the diode opening when the socket-side electrical connector is mechanically mated with and electrically coupled to the pin-side electrical connector.

14 Claims, 6 Drawing Sheets

QUICK DISCONNECT CONNECTOR WITH INTEGRAL SUPPRESSION DIODE

BACKGROUND OF THE INVENTION

1. Field of the Invention

The invention relates generally to electrical connectors and, more particularly, to an electrical connector having a suppression diode for suppressing back electromotive force ("EMF") spikes.

2. Discussion of Prior Art

Electrical connectors are common in the nuclear industry. Generally, electrical connectors can be used to connect an electrical device, such as a power source, to an electromagnetic device, such as a solenoid valve. As is generally known, a suppression diode can be provided in the solenoid valve to minimize damaging back electromotive force ("EMF") spikes from propagating through the electrical connectors and to the electrical device. These back EMF spikes can generate relatively large voltages that cause a number of problems, including arcing at contacts, reduction of switch life, electrical interference, damaged electronics, data loss, etc. However, by positioning the suppression diode in the solenoid valve, heat from the solenoid valve can degrade the suppression diode. Further, it can be difficult and time consuming to remove and replace a faulty suppression diode. Thus, it would be beneficial to modify an existing electrical connector to provide a suppression diode in an easily replaceable location. It would also be beneficial to provide the suppression diode within the electrical connector, such that the suppression diode is shielded from the effects of heat, moisture, pressure, and the like.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In accordance with one aspect, the present invention provides an electrical connector assembly for suppressing a back EMF spike originating from an electromagnetic device. The electrical connector assembly includes a pin-side electrical connector coupled to the electromagnetic device. The pin-side electrical connector includes a diode opening surrounded by an insulating material. The electrical connector assembly includes a socket-side electrical connector for mechanically mating with and electrically coupling to the pin-side electrical connector. The socket-side electrical connector includes a suppression diode for suppressing the back EMF spike from the electromagnetic device. The suppression diode is configured to be positioned within the diode opening when the socket-side electrical connector is mechanically mated with and electrically coupled to the pin-side electrical connector.

In accordance with another aspect, the present invention provides an electrical connector assembly for suppressing a back EMF spike originating from an electromagnetic device. The electrical connector assembly includes a pin-side electrical connector coupled to the electromagnetic device. The electrical connector assembly includes a socket-side electrical connector for mechanically mating with and electrically coupling to the pin-side electrical connector. One of the pin-side electrical connector and socket-side electrical connector includes a suppression diode for suppressing the back EMF spike from the electromagnetic device. The suppression diode being positioned within a diode opening in the other of the pin-side electrical connector and socket-side electrical connector when the pin-side electrical connector is mechanically mated within and electrically coupled to the socket-side electrical connector.

In accordance with another aspect, the present invention provides an electrical connector assembly for suppressing a back EMF spike originating from an electromagnetic device. The electrical connector assembly includes a pin-side electrical connector coupled to the electromagnetic device. The pin-side electrical connector includes a diode opening surrounded by an insulating material. The electrical connector assembly includes a socket-side electrical connector for mechanically mating within and electrically coupling to the pin-side electrical connector and spaced a distance away from the electromagnetic device. The socket-side electrical connector includes a suppression diode for suppressing the back EMF spike from the electromagnetic device. The suppression diode is configured to be positioned within the diode opening when the socket-side electrical connector is mechanically mated with and electrically coupled to the pin-side electrical connector. The suppression diode being removable from the socket-side electrical when the socket-side electrical is disconnected from the pin-side electrical connector.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
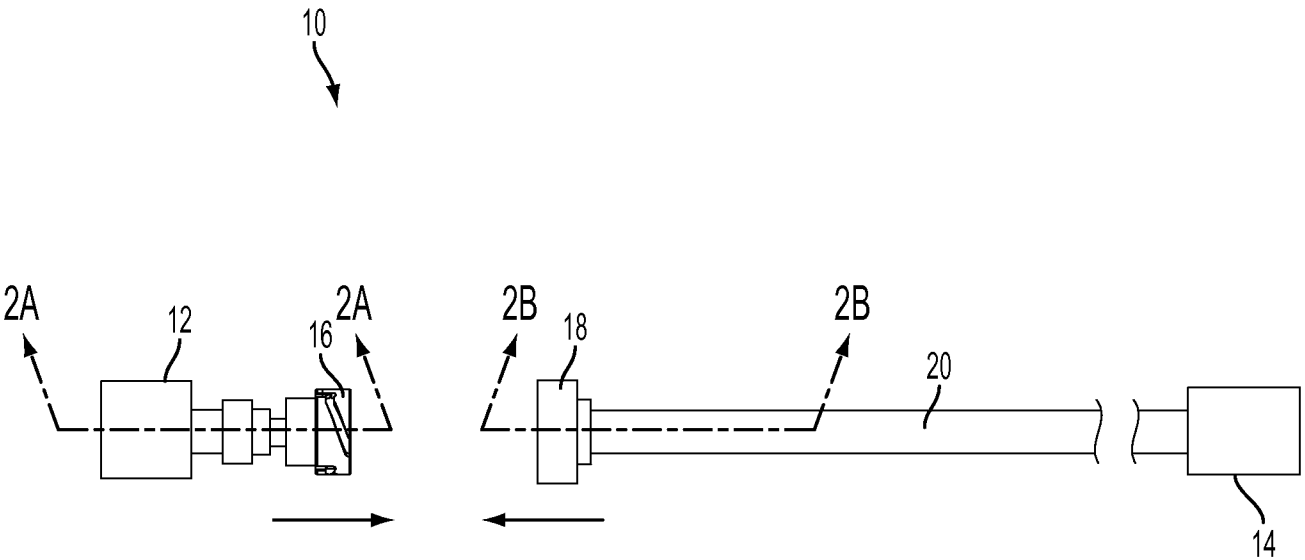
FIG. 1 is a schematic illustration of an example electrical connector assembly in accordance with an aspect of the present invention.

Example embodiments that incorporate one or more aspects of the invention are described and illustrated in the drawings. These illustrated examples are not intended to be a limitation on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements.

FIG. 1 illustrates an example electrical connector assembly 10 according to an aspect of the invention. In short summary, the electrical connector assembly 10 can be used to couple a source of power (shown schematically as an electrical device 14) to an electromagnetic device 12 in a corrosive environment. A pin-side electrical connector 16 can be attached to the electromagnetic device 12 at one end and to a socket-side electrical connector 18 at an opposing end. The ability to attach is schematically represented by the two facing arrowheads within FIG. 1. A socket-side conduit/cable jacket 20 extends from the socket-side electrical connector 18 to the electrical device 14, such as a power source, or the like. As will be described in detail below, the socket-side electrical connector 18 can include a suppression diode, such that back electromotive force ("EMF") spikes originating in the electromagnetic device 12 can be suppressed and/or limited from reaching the electrical device 14.

The electrical connector assembly 10 can be used in a number of environments, and it is to be appreciated that FIG. 1 is only a generic/schematic depiction of the electrical connector assembly 10. For instance, in one example, the electrical connector assembly 10 can be used in a variety of nuclear environments, such as nuclear power plants, nuclear powered ships, or the like. Other example environments can include, but are not limited to, steel mills, factories, hydro plants, etc. Some or all of these environments may contain a relatively high temperature, pressure, humidity, and/or electromagnetic interference. It is to be understood, however, that the electrical connector assembly 10 could be used in nearly any environment, and is not limited to the environments set forth herein.

The electromagnetic device 12 is only generically/schematically depicted in FIG. 1, as it is understood that the electromagnetic device 12 can include a number of different electrical devices. For instance, the electromagnetic device 12 can include a variety electrical devices that exhibit a back EMF spike. A back EMF spike (also known as back EMF) is a voltage or electromotive force that pushes against a current which induces the electromagnetic device 12. Back EMF spikes can be particularly damaging, and may cause arcing at contacts, switch life reduction, electrical interference, damaged electronics, data loss, etc. The electromagnetic device 12 includes any number of different solenoid valves, motors, or the like, some of which may include an electromagnetically inductive coil. In further examples, the electromagnetic device 12 includes a variety of devices that store energy when powered and generate back EMF spikes when the power supply is turned off.

The electromagnetic device 12 is attached (i.e., electrically connected) to the electrical device 14 through the electrical connector assembly 10. The electrical device 14 is somewhat generically/schematically depicted in FIG. 1, as it is to be appreciated that the electrical device 14 includes a number of different electrical devices. For example, the electrical device 14 may include a power source, such as an electrical energy transmission system, batteries, fuel cells, generators, or the like. The electrical device 14 could further include a control system, or the like.

Figure 2B:
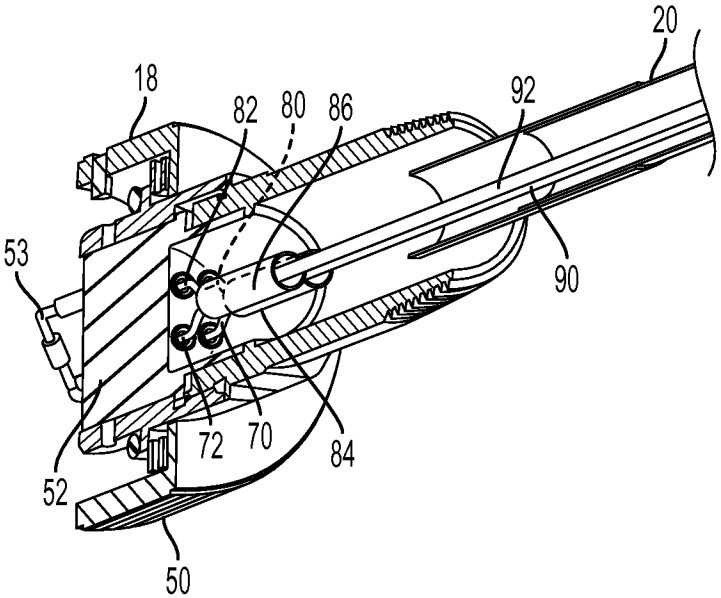
FIG. 2B is a sectional view taken along line 2B-2B of FIG. 1 and shows a portion of the example electrical connector assembly which includes a suppression diode in accordance with an aspect of the present invention.
Figure 2A:
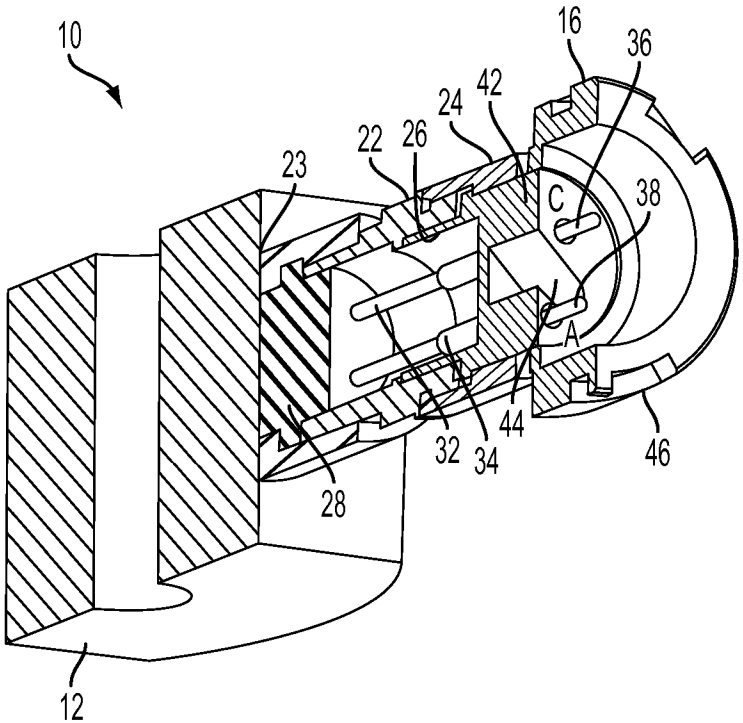
FIG. 2A is a sectional view taken along line 2A-2A of FIG. 1 and shows a portion of the example electrical connector assembly which includes an opening for receiving a suppression diode in accordance with an aspect of the present invention.

Referring now to FIGS. 2A and 2B, the electrical connector assembly 10 can now be described in more detail. It is to be appreciated that the section line 2A-2A and the section line 2B-2B are taken along different directions (e.g., directions approximately 90° different) for the purpose of providing more informative section views in FIGS. 2A and 2B. It is to be appreciated that FIGS. 2A and 2B, taken together shown the electrical connector assembly 10. In view of the section line in FIG. 1 being in different directions (e.g., approximately 90° different), the cross sections of the portions shown in FIGS. 2A and 2B can be considered to be 90° different in orientation with respect to each other. Such is worth mentioning to provide an understanding that the two views of FIGS. 2A and 2B, although generally suggesting the coupling ability of the two connectors 16 and 18, should not be considered as showing a rotational orientation of the two connectors 16, 18 that permits coupling.

Focusing first on FIG. 2A, the pin-side electrical connector 16 is coupled to the electromagnetic device 12. The pin-side electrical connector 16 is attached to the electromagnetic device 12 in any number of ways, such as through a conduit (not shown), backshell, or the like. As such, the pin-side electrical connector 16 can be in operative association (i.e., electrically connected) with the electromagnetic device 12. It is to be appreciated that the pin-side electrical connector 16 can include a variety of different constructions, some of which may be generally known. As such, the pin-side electrical connector 16 shown in FIG. 2A depicts merely one possible example of a pin-side electrical connector.

The pin-side electrical connector 16 can include a backshell 22. The backshell 22 extends along a longitudinal axis between a first end 23 and a second end 24 opposite from the first end 23. In one example, the backshell 22 is attached to the electromagnetic device 12 at the first end. The first end 23 can be attached to the electromagnetic device 12 in a number of ways, such as by a threaded connection, adhesives, mechanical fasteners, or the like. Indeed, in one example, the electromagnetic device 12 includes corresponding attachment structures for attaching to the backshell 22. The backshell 22 further includes an internal bore 26 that is substantially hollow and extends longitudinally between the first end 23 and second end 24. The internal bore 26 includes openings at both ends, such that the backshell 22 can include a number of different structures extending longitudinally through the backshell 22 from the first end 23 to the second end 24. It is to be appreciated that the backshell 22 shown in FIG. 2A comprises only one possible example, as the backshell 22 could be longer or shorter in further examples, and/or could be formed as a single piece or a multiple piece structure.

A potting material 28 can be provided within the backshell 22. The potting material 28 at least partially fills the backshell 22 from the first end 23 towards the second end 24. It is to be appreciated that the potting material 28 can extend nearly any length along the backshell 22 from the first end 23. For example, the potting material 28 in FIG. 2A extends from the first end 23 and terminates before reaching the second end 24, but could extend a longer or shorter distance in other examples. The potting material 28 includes a number of different materials that can block moisture, including corrosive moisture, from migrating into the internal bore 26 of the backshell 22. In one example, the potting material includes an epoxy resin, though a number of different types of materials are envisioned.

The pin-side electrical connector 16 further includes one or more pin-side conductors. In the example of FIG. 2A, the pin-side electrical connector 16 includes a first pin-side conductor 32 and a second pin-side conductor 34. The first pin-side conductor 32 and second pin-side conductor 34 each extend longitudinally along the length of the pin-side electrical connector 16 and through the internal bore 26 of the backshell 22. The first pin-side conductor 32 and a second pin-side conductor 34 are electrically connected, such as by wire soldering, or the like, to the electromagnetic device 12.

As such, the first pin-side conductor 32 and second pin-side conductor 34 are each in electrical communication with the electromagnetic device 12. Though not shown in the examples, it is to be appreciated that in further examples, the pin-side conductors can include a number of different protective materials, such as braided shields, insulating materials, etc. Indeed, the first pin-side conductor 32 and second pin-side conductor 34 are depicted somewhat generically in FIG. 2A, and could include a number of different structures and designs.

The pin-side electrical connector 16 further may include one or more extension pins. In the shown example, the pin-side electrical connector 16 includes a first pin 36 and a second pin 38. The first pin 36 and second pin 38 extend in a direction away from the pin-side electrical connector 16. The first pin 36 and second pin 38 can be attached to the first pin-side conductor 32 and second pin-side conductor 34 within the pin-side electrical connector 16, such that the pins and conductors are electrically connected. The pins and conductors can be electrically connected in any number of ways, such as with pin extenders, wire soldering, or the like. It is to be appreciated that the first pin 36 and second pin 38 shown and described herein comprise merely one possible example, as the first pin 36 and second pin 38 could include a variety of different constructions, such as extending a longer or shorter distance, having a larger or smaller cross-sectional width, etc.

The pin-side electrical connector 16 further includes an insulating material 42. The insulating material 42 is positioned at an end of the pin-side electrical connector 16 opposite from the electromagnetic device 12. In one example, the insulating material 42 substantially surrounds the first pin 36 and second pin 38 such that the first pin 36 and second pin 38 are generally insulated from each other. The insulating material 42 can include a number of different materials, including, but not limited to, dielectric insulating materials, or other insulating materials that can provide relatively high temperature resistance and/or dielectric properties. In one example, the insulating material 42 is formed as a single piece structure though, in further examples, the insulating material 42 can include more than one layer. In the case of multiple layers of the insulating material 42, the insulating material 42 need not be the same material throughout, and could include different layers formed of different materials.

Figure 3:
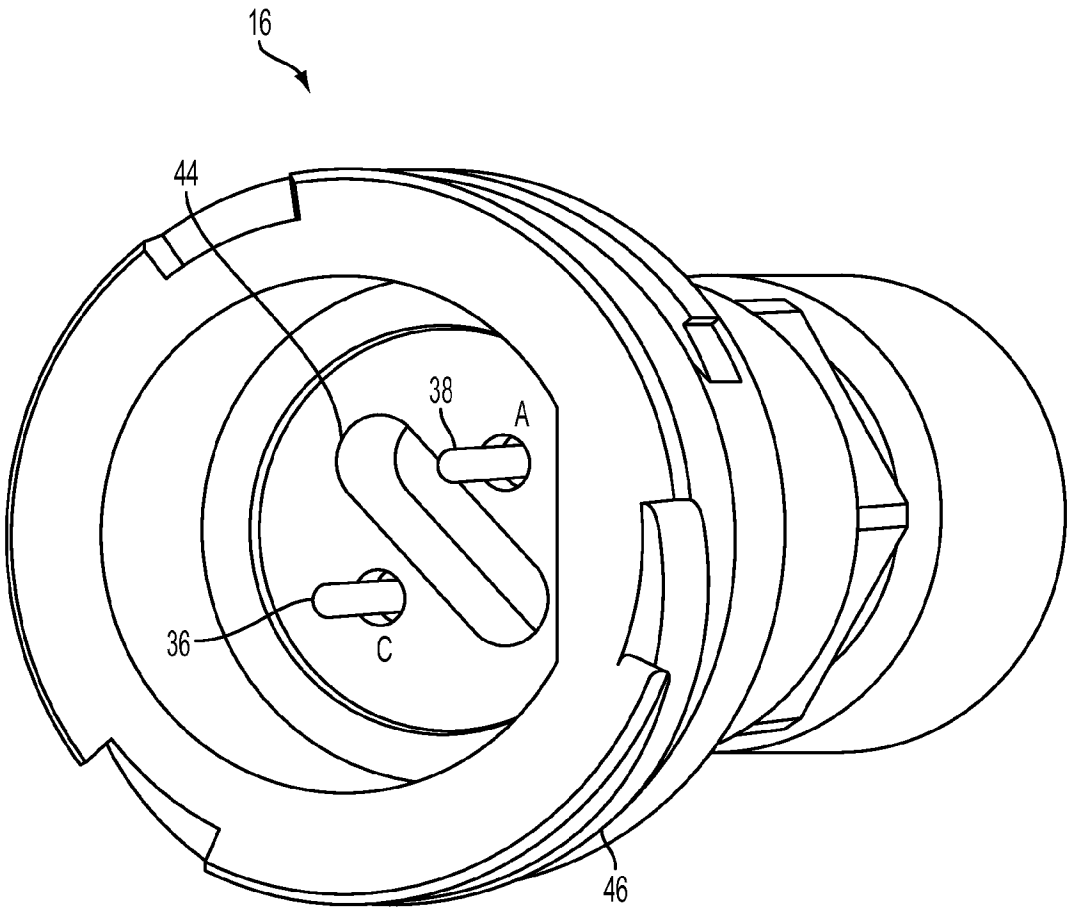
FIG. 3 is a perspective view of a pin-side electrical connector of the example electrical connector assembly.

The insulating material 42 further includes a diode opening 44. As shown in FIGS. 2A and 3, the diode opening 44 is substantially surrounded by the insulating material 42 and can extend longitudinally into the insulating material 42 of the pin-side electrical connector 16. The diode opening 44 can be arranged to extend between the first pin 36 and second pin 38. The diode opening 44 includes a generally rectangularly shaped hollow opening having rounded opposing ends. Of course, it is to be appreciated that the diode opening 44 is not limited to such a structure and, in further examples, could include a number of sizes and shapes. For example, the diode opening 44 could include any number of quadrilateral shapes, such as a rectangular shapes having non-rounded edges, square shapes, etc., or, may further include non-quadrilateral shapes, such as oval shapes, circular shapes, or the like. Similarly, the diode opening 44 could have a larger or smaller length or width and/or could extend a larger or smaller distance (e.g., depth) into the insulating material 42 than as shown in FIG. 3. As such, it is to be appreciated that the diode opening 44 shown herein comprises merely one possible example, as a number of different embodiments are envisioned. The diode opening 44 can be formed in any number of ways, such as by machining/milling the opening in the insulating material 42, or the like. In a further example, the diode opening 44 could be positioned within the socket-side electrical connector 18, as opposed to the pin-side electrical connector 16.

The diode opening 44 can receive and/or house a variety of structures. For example, the diode opening 44 is sized to receive any number of electrical devices. The diode opening 44 provides protection to the electrical devices that are positioned within the diode opening 44. In one example, the insulating material 42 that surrounds the diode opening 44 reduces a number of environmental effects that may otherwise affect the electrical device. For instance, the insulating material 42 can reduce the effects of heat, moisture, pressure, or the like on electrical devices positioned within the diode opening 44.

The pin-side electrical connector 16 can further include a pin side head 46. The pin side head 46 is attached to the end of the pin-side electrical connector 16 and substantially surrounds the insulating material 42. The pin side head 46 can function similarly or identically to a bayonet-type locking ring and can extend circumferentially around the pin-side electrical connector 16. In one example, the pin side head 46 includes grooves in an outer circumferential surface that can mate with corresponding pins, projections, or the like in the socket-side electrical connector 18. It is to be appreciated that the pin side head 46 is somewhat generically depicted, as the pin side head 46 can include any number of structures, some of which may be generally known. Indeed, the pin side head 46 can function to removably attach the pin-side electrical connector 16 to the socket-side electrical connector 18, and need not be limited to the examples shown and described herein.

The electrical connector assembly 10 further includes the socket-side electrical connector 18 (FIG. 2B). The socket-side electrical connector 18 can be mechanically mated within and electrically coupling to the pin-side electrical connector 16. As such, the socket-side electrical connector 18 can be in operative association (i.e., electrically connected) to the electromagnetic device 12. It is to be appreciated that the socket-side electrical connector 18 can include a variety of different constructions, some of which may be generally known. Further, the socket-side electrical connector 18 (FIG. 2B) is shown in a detached state from the pin-side electrical connector 16 (FIG. 2A). However, it is to be appreciated that in an operative state, the socket-side electrical connector 18 is attached to the pin-side electrical connector 16 and can be readily attached and/or detached.

The socket-side electrical connector 18 can include a bayonet ring 50. The bayonet ring 50 is attached at an end of the socket-side electrical connector 18 adjacent the pin-side electrical connector 16. The bayonet ring 50 can be sized and shaped to attach to the pin side head 46 and/or form a seal. It is to be appreciated that the bayonet ring 50 comprises only one possible example of a means for attaching the socket-side electrical connector 18 to the pin-side electrical connector 16.

The socket-side electrical connector 18 further includes an insulating material 52. The insulating material 52 can be similar or identical to the insulating material 52 in the pin-side electrical connector 16. The insulating material 52 is positioned at an end of the socket-side electrical connector 18 within the bayonet ring 50. The insulating material can include a number of different materials including, but not limited to, dielectric insulating materials, or other insulating materials that can provide relatively high temperature resistance and/or dielectric properties. In one example, insulating material 52 is formed as a single piece structure though, in further examples, the insulating material 52 can include more than one layer. In the case of multiple layers of the insulating material 52, the insulating material 52 need not be the same material throughout, and could include different layers formed of different materials. The insulating material 52 can include one or more openings extending longitudinally therethrough, allowing for a number of different structures and/or electrical devices to pass through the insulating material 52.

Figure 4:
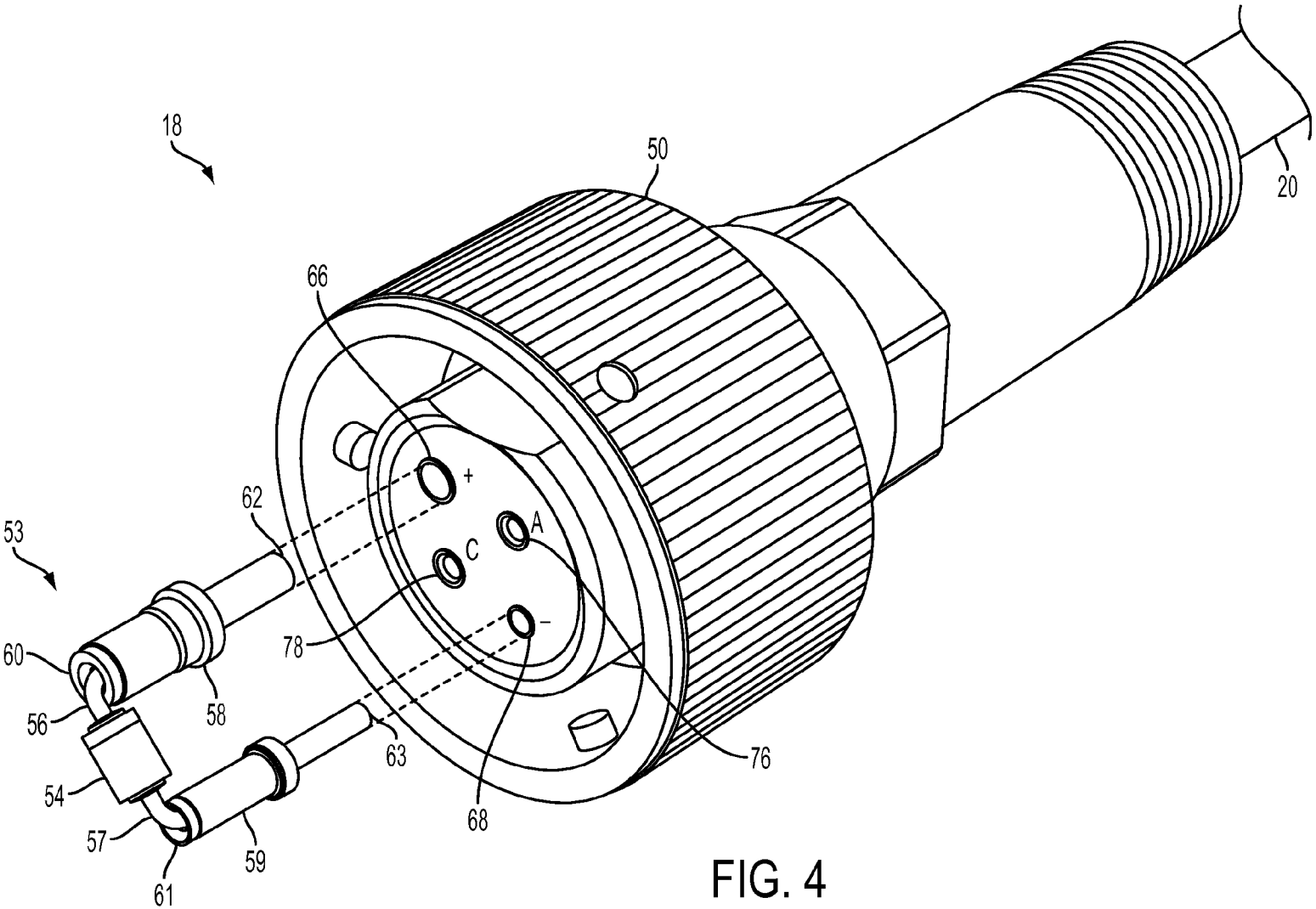
FIG. 4 is a partially exploded view of a socket-side electrical connector including an example diode assembly.

The socket-side electrical connector 18 can further include a diode assembly 53. The diode assembly 53 is somewhat generically depicted in FIG. 2B, and is more clearly shown in FIG. 4. Referring briefly to FIG. 4, the structure of the diode assembly can be more fully described. It is to be understood that diode assembly 53 is shown in a partially exploded state and detached from the socket-side electrical connector 18 for illustrative purposes and to more clearly show the structure of the diode assembly 53. However, it is to be appreciated that in an operational state, the diode assembly 53 is attached to the socket-side electrical connector 18. In a further example, the diode assembly 53 could be attached to the pin-side electrical connector 16 instead of the socket-side electrical connector 18.

The diode assembly 53 can include a suppression diode 54 for suppressing back EMF spikes from the electromagnetic device 12. The suppression diode 54 can include any number of different types of suppression diodes that function to minimize voltage spikes by shunting excess current. The suppression diode 54 can be unidirectional and may operate as a rectifier in a forward direction. As is generally known, the suppression diode 54 allows for current to flow in one direction (e.g., a forward direction) while blocking current flow in an opposite direction (e.g., a reverse direction). The suppression diode 54 includes a positive leg 57 and a negative leg 56. As is generally known, current will flow from the positive leg 57, also known as the anode, through the suppression diode 54 and to the negative leg 56, also known as the cathode, and is prevented from flowing in the reverse direction.

The diode assembly 53 can further include a positive pin contact 58 and a negative pin contact 59. The positive pin contact 58 and negative pin contact 59 are each elongated, substantially hollow structures extending longitudinally between a first end and an opposing second end. In one example, the positive pin contact 58 and negative pin contact 59 can each have different sizes. For example, the positive pin contact 58 has a larger cross-sectional width (e.g., diameter in the shown example) than the negative pin contact 59. Of course, it is to be appreciated that the positive pin contact 58 and negative pin contact 59 need not be limited to the sizes and shapes shown in FIG. 4, and could have larger or smaller cross-sectional widths, longer or shorter lengths, and/or may include non-circular cross-sectional shapes, such as a square shape, oval shape, or the like. Indeed, in further examples, the positive pin contact 58 could include a smaller cross-sectional width than the negative pin contact 59. As such, it is to be understood that the positive pin contact 58 and negative pin contact 59 shown in FIG. 4 comprises merely one possible example, as a number of embodiments are envisioned.

The positive pin contact 58 and negative pin contact 59 can each include a leg shim. In particular, the positive pin contact 58 includes a positive leg shim 60 while the negative pin contact 59 includes a negative leg shim 61. The leg shims are positioned within respective ends of the pin contacts. In one example, the positive leg shim 60 has a slightly larger cross-sectional width than the negative leg shim 61 to accommodate for the positive pin contact 58 being larger than the negative pin contact 59. Each of the positive leg shim 60 and negative leg shim 61 can include an opening sized to receive a leg from the suppression diode 54. In particular, the positive leg shim 60 can receive the positive leg 57 while the negative leg shim 61 can receive the negative leg 56. As is generally known, the leg shims can assist in placing the suppression diode 54 in electrical contact with the pin contacts. For example, the pin contacts can each have a larger cross-sectional width than the positive leg 57 and negative leg 56. As such, the positive and negative leg shims can accommodate for this size difference and allow for the positive leg 57 to be in electrical contact with the positive pin contact 58 and the negative leg 56 to be in electrical contact with the negative pin contact 59. In a further example, the positive leg 57 and negative leg 56 can be non-removably attached to the positive leg shim 60 and negative leg shim 61, respectively, such as by crimping, or the like.

The positive pin contact 58 and negative pin contact 59 can further include a positive contact 62 and a negative contact 63. The positive contact 62 and negative contact 63 are positioned at ends of the pin contacts that are opposite from the positive and negative leg shims 60, 61. The positive contact 62 and negative contact 63 are in electrical contact with the positive leg 57 and negative leg 56 of the suppression diode 54. The positive contact 62 and negative contact 63 define a generally circular cross-sectional shape, though other shapes are envisioned. In one example, the positive contact 62 has a larger cross-sectional width than the negative contact 63. It is to be appreciated that in further examples, however, the respective sizes of the positive contact 62 and negative contact 63 could be switched, such that the positive contact 62 has a smaller cross-sectional width than the negative contact 63.

The socket-side electrical connector 18 includes a positive contact opening 66 and a negative contact opening 68. The positive contact opening 66 and negative contact opening 68 are sized to receive the positive contact 62 and negative contact 63, respectively. The positive contact opening 66 is sized and shaped to receive the positive contact 62 while the negative contact opening 68 is sized and shaped to receive the negative contact 63. In one example, the positive contact opening 66 has a larger cross-sectional width (e.g., diameter in the shown example) than the negative contact opening 68 to accommodate for the larger positive contact. Of course, as set forth above, it is to be appreciated that the relative sizes of the positive contact 62 and negative contact 63 could be switched, such that the positive contact opening 66 is smaller than the negative contact opening 68. By having differently sized contact openings, it can be assured that a user will not inadvertently place the diode assembly 53 backwards, in which the suppression diode 54 is reverse biased relative to the electromagnetic device 12. In this example, a user can readily replace the suppression diode 54 by removing the diode assembly 53 from the contact openings 66, 68 and re-inserting a new diode assembly into the contact openings 66, 68.

The socket-side electrical connector 18 can further include a first socket opening 78 and a second socket opening 76. The socket openings 76, 78 can be sized to receive the first pin 36 and second pin 38 from the pin-side electrical connector 16. The socket openings 76, 78 can each define a substantially hollow internal bore extending longitudinally through the insulating material 52. The socket openings 76, 78 are separated from each other with the insulating material 52 in between, such that the socket openings 76 are substantially isolated from each other and from the positive contact opening 66 and negative contact opening 68. In one example, the first pin 36 is inserted into the first socket opening 78 while the second pin 38 is inserted into the second socket opening 76. Once the first socket opening 78 and second socket opening 76 receive the first pin 36 and second pin 38, respectively, the socket-side electrical connector 18 is mechanically mated and electrically coupled to the pin-side electrical connector 16.

Referring back to FIG. 2B, the socket-side electrical connector 18 further includes electrical components, such as wires, that are electrically coupled to the contact openings 66, 68 and socket openings 76, 78. The socket-side electrical connector 18 includes a first diode leg wire 70 and a second diode leg wire 82. The first diode leg wire 70 is electrically coupled to the negative contact opening 68 while the second diode leg wire 82 is electrically coupled to the positive contact opening 66. The contact openings and diode leg wires can be electrically coupled in any number of ways, such as by soldering or the like. The diode leg wires 70, 82 can extend within the socket-side electrical connector 18 from the contact openings 66, 68 and through the insulating material 52. In a further example, an opening, conduit, or the like can be provided extending through the insulating material 52 through which the diode leg wires 70, 82 can pass. Similarly, the diode leg wires 70, 82 can comprise wires, conductors, or other similar electrically conductive elements. In other examples, the diode leg wires 70, 82 could extend a longer or shorter distance than as shown and/or could include an insulating cover, such as a sheath, or the like.

The socket-side electrical connector 18 further includes a first socket lead 80 (shown in phantom in FIG. 2B as the first socket lead 80 is not visible in such a view) and second socket lead 72. The first socket lead 80 and second socket lead 72 are electrically coupled to the second socket opening 76 and first socket opening 78, respectively. As is generally known, the socket leads 80, 72 can be electrically coupled in any number of ways, such as by soldering, or the like. Accordingly, the socket leads 80, 72 are in electrical contact with the first pin 36 and second pin 38 of the pin-side electrical connector 16 when the pins are inserted into the socket openings 76, 78. The socket leads 80, 72 can extend within the socket-side electrical connector 18 from the socket openings 76, 78 at one end and through the insulating material 52 in a direction away from the socket openings 76, 78. Of course, it is to be appreciated that the socket leads 80, 72 are somewhat generically depicted and, in further examples, can include a number of different structures. For example, the socket leads 80, 72 can comprise wires, conductors, or other similar electrically conductive elements. Similarly, the socket leads 80, 72 could extend a longer or shorter distance than as shown and/or could include an insulating cover, such as a sheath, or the like.

The socket leads 80, 72 can be electrically coupled to the diode leg wires 70, 82. In one example, the first socket lead 80 is electrically coupled to the first diode leg wire 70 at a first splice 84 while the second socket lead 72 is electrically coupled to the second diode leg wire 82 at a second splice 86. The socket leads 80, 72 and diode leg wires 70, 82 can be electrically coupled in any number of ways. For example, soldering, a butt splice, or the like could be provided to electrically connect the first socket lead 80 to the first diode leg wire 70 and the second socket lead 72 to the second diode leg wire 82. Of course, it is to be appreciated that other methods of electrical coupling, some of which may be generally known, are also envisioned. The first splice 84 and second splice 86 are positioned within the socket-side electrical connector 18. For further protection, the first splice 84 and second splice 86 can be covered with an insulating material.

The socket-side electrical connector 18 further includes a first socket-side conductor 90 and a second socket-side conductor 92. The first socket-side conductor 90 and second socket-side conductor 92 can each extend longitudinally through the socket-side electrical connector 18 and through the socket-side conduit 20. The first socket-side conductor 90 is electrically connected to the first splice 84 while the second socket-side conductor 92 is electrically connected to the second splice 86. The socket-side conductors can be attached to the first splice 84 and second splice 86 in any number of ways, such as with pin extenders, solder, or the like. As is generally known, each of the first socket-side conductor 90 and second socket-side conductor 92 can further be surrounded by a cable jacket, heat shrink tubing, braid shield, or other similar outer protective layer that can cover the conductors. The first socket-side conductor 90 and second socket-side conductor 92 can each be electrically coupled to the electrical device 14, such as a power source, or the like. In one example, the first socket-side conductor 90 is electrically coupled to a positive terminal of the power source while the second socket-side conductor 92 is electrically coupled to a negative terminal of the power source.

The operation of the electrical connector assembly 10 can now be described. Initially, the pin-side electrical connector 16 is electrically coupled to the socket-side electrical connector 18. Once connected, the first pin 36 is inserted into the first socket opening 78 while the second pin 38 is inserted into the second socket opening 76. As such, the pin-side electrical connector 16 is electrically coupled to the electromagnetic device 12 through the socket-side electrical connector 18.

Figure 5:
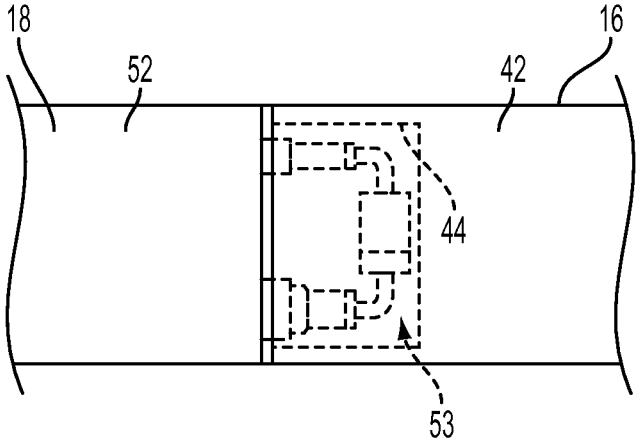
FIG. 5 is a front elevation view of the diode assembly of the socket-side electrical connector positioned within a diode housing of the pin-side electrical connector.

Referring first to FIG. 5, the pin-side electrical connector 16 is shown attached to the socket-side electrical connector 18. It is to be appreciated that FIG. 5 somewhat generically depicts the pin-side electrical connector 16 connected socket-side electrical connector 18 for illustrative purposes. Indeed, in this example, neither of the pin side head 46 nor the bayonet ring 50 are shown, so as to more clearly depict the diode assembly 53 and the diode opening 44. Of course, it is to be appreciated that in a fully assembled state, the pin side head 46 can engage the bayonet ring 50 to attach the pin-side electrical connector 16 to the socket-side electrical connector 18.

As shown in FIG. 5, the insulating material 42 of the pin-side electrical connector 16 is in close proximity with the insulating material 52 of the socket-side electrical connector 18. In this example, the diode assembly 53 is attached to the socket-side electrical connector 18 and extends partially outwardly from the insulating material 52. As such, the diode assembly 53, including the suppression diode 54, is positioned within the diode opening 44. The diode assembly 53 is slightly smaller in size than the diode opening 44, such that the diode assembly 53 can easily fit within the diode opening 44. The diode opening 44 therefore envelopes the diode assembly 53 and provides protection to the suppression diode 54 from heat, moisture, pressure, or the like.

Figure 6:
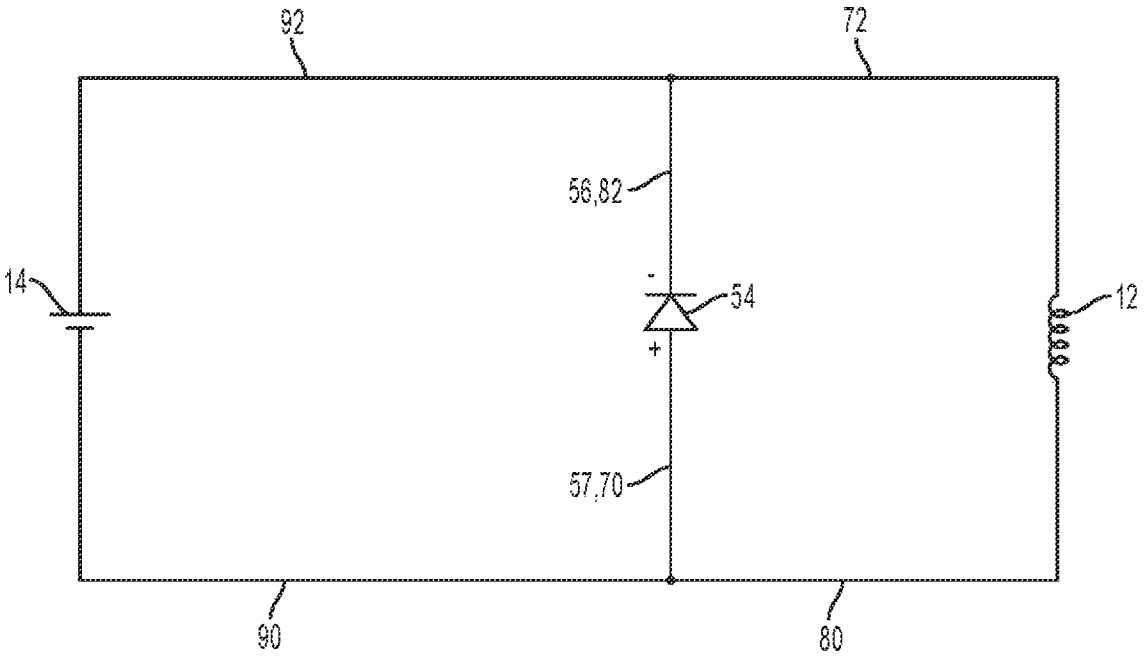
FIG. 6 is a schematic view of the suppression diode wiring in accordance with an aspect of the present invention.

Referring now to FIG. 6, a wiring diagram of the electromagnetic device 12, electrical device 14, and suppression diode 54 is shown. The electromagnetic device 12 is electrically coupled to the electrical device 14 when the pin-side electrical connector 16 is mated with the socket-side electrical connector 18. Current can flow from the positive terminal of the electrical device 14, through the second socket-side conductor 92, second socket lead 72, second socket 76, second pin 38, and second pin-side conductor 34 to the electromagnetic device 12, thereby energizing the electromagnetic device 12. As is generally known, current will not flow through the suppression diode 54 from the second socket-side conductor 92, through the second diode leg wire 82, contacts 66, 62, and through the negative leg 56 due to the suppression diode 54 being reverse biased against the electrical device 14.

Once the electromagnetic device 12 is shut off (i.e., power from the electrical device 14 is terminated), a back EMF spike from the electromagnetic device 12 may occur. The suppression diode 54 assists in controlling this back EMF spike and limiting damage at the electrical device 14 due to the spike. In the example shown, the suppression diode 54 is forward biased relative to the electromagnetic device 12. Accordingly, with the electrical device 14 turned off, built up current in the electromagnetic device 12 will flow through the first pin-side conductor 32, through the first pin 36, socket 78 then through the first socket lead 80, first diode leg wire, and contacts 68, 63. Current will then be allowed through the positive leg 57 and the suppression diode 54. The suppression diode 54 will continue to allow current from the electromagnetic device 12 in a circular loop until it is dissipated. Accordingly, the suppression diode 54 can suppress the back EMF spike from the electromagnetic device 12 when power is shut off.

By positioning the suppression diode 54 in the socket-side electrical connector 18, the suppression diode 54 is positioned a distance away from the electromagnetic device 12. Further, due to relatively high temperatures near the electromagnetic device 12, the suppression diode 54 can be stored at a somewhat lower temperature. The diode opening 44 in the pin-side electrical connector 16 further shields the suppression diode 54 from the temperatures and pressures near the electromagnetic device 12. In the event that the suppression diode 54 needs to be replaced, the pin-side electrical connector 16 can be detached from the socket-side electrical connector 18, and the diode assembly 53 can be removed from the contact openings 66, 68. A new diode assembly can then be inserted into the contact openings.

It is to be appreciated that the presented example is just one example within the broad scope of the present invention. It is to be appreciated that the present invention is to be considered broader that the single presented example. For example, the presence of the suppression diode 54 and the diode opening 44 on the socket-side electrical connector 18 and the pin-side electrical connector 16 could be reversed so that the diode is on the pin-side electrical connector 16 and the diode opening 44 is on socket-side electrical connector 18.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An electrical connector assembly for suppressing a back EMF spike originating from an electromagnetic device, the electrical connector assembly including:

a pin-side electrical connector coupled to the electromagnetic device, the pin-side electrical connector including a diode opening surrounded by an insulating material; and a socket-side electrical connector for mechanically mating with and electrically coupling to the pin-side electrical connector, the socket-side electrical connector including a suppression diode for suppressing the back EMF spike from the electromagnetic device, wherein the suppression diode is configured to be positioned within the diode opening when the socket-side electrical connector is mechanically mated with and electrically coupled to the pin-side electrical connector, wherein the pin-side electrical connector includes first and second pin-side conductors electrically coupled to the electromagnetic device, the first and second pin-side conductors extending longitudinally through an internal bore of the pin-side electrical connector, and wherein the first and second pin-side conductors are electrically coupled to first and second pins, the first and second pins extending outwardly from the pin-side electrical connector.

2. The electrical connector assembly of claim 1, wherein the diode opening is positioned between the first and second pins, the diode opening defining a substantially hollow opening extending longitudinally into the pin-side electrical connector.

3. The electrical connector assembly of claim 1, wherein the socket-side electrical connector includes first and second socket openings configured to receive the first and second pins, each of the first and second socket openings being electrically connected to a socket-side conductor.

4. The electrical connector assembly of claim 3, wherein the suppression diode is included as part of a diode assembly.

5. The electrical connector assembly of claim 4, wherein the diode assembly includes a positive pin contact for receiving a positive leg of the suppression diode and a negative pin contact for receiving a negative leg of the suppression diode, the positive pin contact and negative pin contact having different diameters.

6. The electrical connector assembly of claim 5, wherein the positive pin contact is removably inserted into a positive contact opening in the socket-side electrical connector and the negative pin contact is removably inserted into a negative contact opening in the socket-side electrical connector, the positive contact opening and negative contact opening having differently sized openings.

7. The electrical connector assembly of claim 1, wherein the suppression diode is forward biased relative to the electromagnetic device.

8. An electrical connector assembly for suppressing a back EMF spike originating from an electromagnetic device, the electrical connector assembly including:

a pin-side electrical connector coupled to the electromagnetic device; and a socket-side electrical connector for mechanically mating with and electrically coupling to the pin-side electrical connector;

wherein the socket-side electrical connector includes a suppression diode for suppressing the back EMF spike from the electromagnetic device, the suppression diode being positioned within a diode opening in the pin-side electrical connector when the pin-side electrical connector is mechanically mated within and electrically coupled to the socket-side electrical connector, and wherein the suppression diode projects outwardly in a direction away from the socket-side electrical connector.

9. The electrical connector assembly of claim 8, wherein the diode opening defines a substantially hollow opening extending longitudinally into the pin-side electrical connector.

10. The electrical connector assembly of claim 9, wherein the diode opening is substantially surrounded by an insulating material, the insulating material being configured to reduce effects of heat on the suppression diode within the diode opening.

11. The electrical connector assembly of claim 8, wherein when the socket-side electrical connector is coupled to the pin-side electrical connector, a seal is provided between the socket-side electrical connector and pin-side electrical connector.

12. The electrical connector assembly of claim 11, wherein the suppression diode is configured to be shielded from heat, moisture, and pressure when the socket-side electrical connector is coupled to the pin-side electrical connector.

13. An electrical connector assembly for suppressing a back EMF spike originating from an electromagnetic device, the electrical connector assembly including:

a pin-side electrical connector coupled to the electromagnetic device, the pin-side electrical connector including a diode opening surrounded by an insulating material; and a socket-side electrical connector for mechanically mating within and electrically coupling to the pin-side electrical connector and spaced a distance away from the electromagnetic device, the socket-side electrical connector including a suppression diode for suppressing the back EMF spike from the electromagnetic device, wherein the suppression diode is configured to be positioned within the diode opening when the socket-side electrical is mechanically mated with and electrically coupled to the pin-side electrical connector, the suppression diode being removable from the socket-side electrical when the socket-side electrical connector is disconnected from the pin-side electrical connector, wherein the suppression diode includes a positive leg and a negative leg, and wherein each of the positive leg and negative leg of the suppression diode is electrically coupled to one of the socket-side conductors in the socket-side electrical connector such that the suppression diode is wired in parallel with respect to the electromagnetic device.

14. The electrical connector assembly of claim 13, wherein the socket-side electrical connector includes first and second socket openings configured to receive first and second pins from the pin-side electrical connector, each of the first and second socket openings being electrically connected to a first and second socket-side conductor.

* * * * *